US005443654A

United States Patent [19]

Hiltunen et al.

[11] Patent Number: 5,443,654

[45] Date of Patent: Aug. 22, 1995

[54] METHOD OF REMOVING DEPOSITS FROM THE WALLS OF A GAS COOLER INLET DUCT, AND A GAS COOLER INLET DUCT HAVING A COOLED ELASTIC METAL STRUCTURE

[75] Inventors: Matti A. Hiltunen, Karhula; Ossi Ikonen, Pieksämäki, both of Finland

[73] Assignee: A. Ahlstrom Corporation, Noormarkku, Finland

[21] Appl. No.: 185,834

[22] PCT Filed: Jul. 9, 1992

[86] PCT No.: PCT/FI92/00210

§ 371 Date: Jan. 24, 1994

§ 102(e) Date: Jan. 24, 1994

[87] PCT Pub. No.: WO93/02331

PCT Pub. Date: Feb. 4, 1993

[30] Foreign Application Priority Data

Jul. 23, 1991 [FI] Finland ..... 913515

[51] Int. Cl.[6] ..... B08B 5/00; B08B 9/00; B08B 7/00

[52] U.S. Cl. ..... 134/22.12; 134/8; 134/16; 134/37; 134/22.18

[58] Field of Search ..... 134/22.12, 22.18, 8, 134/37, 16, 201, 108; 34/363, 359, 591, 576

[56] References Cited

U.S. PATENT DOCUMENTS 2,971,830 2/1961 Kawai et al. ..... 48/206
4,874,037 10/1989 Papst et al. ..... 165/47

FOREIGN PATENT DOCUMENTS 0291115 11/1988 European Pat. Off. .
20291115 11/1988 European Pat. Off. .
20319634 6/1989 European Pat. Off. .
2140144 11/1984 United Kingdom .
634080 11/1978 U.S.S.R. .

*Primary Examiner*—David A. Simmons
*Assistant Examiner*—Zeinab El-Arini
*Attorney, Agent, or Firm*—Nixon & Vanderhye

[57] ABSTRACT

A fluidized bed gas cooler assembly includes a fluidized bed gas cooler with a metal inlet duct for directing hot process or flue gases into the cooler as fluidizing gas. In order to remove deposits which form on the duct inner surface a cooling fluid is passed into and then out of contact with the outer surface of the inlet duct so that the cooling fluid increases in temperature (but does not change phase) and so that deposits which form on the inlet duct interior surface become brittle and readily disengageable. The deposits are disengaged at different times by pulsation of the cooling fluid (especially where the inlet duct is a metal spiral tube), effecting pulsation of the temperature of the cooling fluid, or subjecting an enclosure surrounding the duct or the exterior surface of the duct itself to a sudden mechanical force.

26 Claims, 2 Drawing Sheets

METHOD OF REMOVING DEPOSITS FROM THE WALLS OF A GAS COOLER INLET DUCT, AND A GAS COOLER INLET DUCT HAVING A COOLED ELASTIC METAL STRUCTURE

BACKGROUND AND SUMMARY OF THE INVENTION

The present invention relates to a method and apparatus for introducing hot process or flue gases through an inlet duct into a gas cooler. The method and apparatus according to the invention are especially suitable for feeding hot gases as fluidizing gas into a gas cooler provided with a fluidized bed.

Hot process gases usually contain fouling components, such as fine dust and molten or evaporated components, which turn sticky when they cool and condense, thereby adhering to each other and to surfaces in contact with the gases. In this way, these fouling components may very fast grow harmful deposits on the wall surfaces in contact with the process gases. Usually, the deposits seem to accumulate most easily in the border area between the hot and the cooled surfaces. For example, gas inlets of waste heat boilers are places where such deposits usually accumulate. Consequently, the inlet becomes easily clogged unless swept at times. Sweeping as such may be difficult in those hot conditions.

Furthermore, it is normally difficult to disengage the deposits accumulated in the hot inlet opening because the deposits accumulating on hot surfaces are hard and compact. In most cases, the inlet ducts are of refractory-lined construction or of ceramic material, having a slightly uneven and possibly even porous surface, which contributes to the adhesion of deposits to the surfaces. Sweeping of a refractory-lined surface may in turn damage the refractory lining.

The formation of deposits has been attempted to prevent, e.g., by blowing gas which is, for example, recirculated, cooled and purified process gas, into the inlet. This prevents, to some extent, sticky compounds from adhering to the walls in the vicinity of the inlet. However, the volume of the recirculated gas has to be considerably large in order to keep the inlet clear. This enlarges the overall gas volume entering the gas cooler, which grows the dimensions of the gas cooler and subsequent gas cooling means, in other words, increases the costs. Furthermore, the efficiency of heat recovery from the gases is lowered by mixing of cooled gas with hot process gases prior to heat recovery units.

An object of the present invention is to provide an improved method and apparatus for introducing hot process gases into a gas cooler in comparison with those described hereinabove.

An object is especially to provide a method and apparatus by which the deposits accumulated in the hot gas inlet duct are readily removable.

A still further ojject is to provide a method and apparatus by which the properties of the deposits accumulated in the inlet duct allow such deposits to be readily disengaged from the duct walls.

A characteristic feature of the method according to the invention for introducing hot process or flue gases into a cooling chamber is that the inlet duct wall is indirectly cooled with a cooling medium by bringing the wall surface opposite to the gas side surface into contact with the cooling medium, whereby the deposits formed on the wall surface on the inlet duct gas side embrittle and become readily removable.

For disengaging the deposits from the inlet duct walls, these walls are subjected to a sudden mechanical force, which causes a temporary deformation or vibration of the wall, thereby loosening the deposits accumulated on the wall surface.

A characteristic feature of the apparatus according to the invention for introducing hot process or flue gases into a gas cooler is that the inlet duct of the gas cooler is formed of a cooled, elastic structure, in which the inlet duct walls are formed of cooled surfaces made of metal.

The inlet duct is preferably provided with an apparatus by which the inlet duct walls may be subjected to a sudden mechanical force, which causes a temporary deformation and/or vibration of the walls.

The invention is especially suitable for plants where hot process gases are cooled in a cooling chamber provided with a fluidized bed and where the hot process gas simultaneously serves as a fluidizing gas. In this case, the inlet duct is arranged in the bottom of the cooling chamber and hot gases are introduced into the fluidized bed via an inlet arranged in the bottom of the cooling chamber. Cooling is most preferably effected in a gas cooler provided with a circulating fluidized bed, where hot gases are introcuded into a mixing chamber and mixed with recirculated, cooled particles, whereby the gases cool very fast.

If the inlet duct is too short, particles may flow from the fluidized bed of the cooling chamber downwardly to the inlet duct with harmful results. Some turbulence is formed in the inlet, between the inlet duct and the cooling chamber, when the particles flowing downwardly along the cooling chamber walls meet the hot gases. The particles may thus flow downwardly into the inlet duct. From the inlet duct the particles are, however, carried away by the hot gases back to the cooling chamber provided that the inlet duct is of a certain minimum length. The ratio of the inlet duct length to the inlet duct diameter L/D has to be at least 0.5, preferably 1 to 2. For example, plants with the gas flow of 1000–200,000 $Nm^3/h$ which are equipped with an approximately 5 to 30 m high gas cooling reactor provided with a fluidized bed and having a mixing chamber with an approximately 70 cm to 6 m diameter, may have an inlet duct with a diameter of approximately 15 cm to 2 m and height of 15 cm to 2 m.

The inlet duct is preferably made of such a material that provides the duct structure with a certain flexibility or elasticity. The duct structure itself may also be flexible.

In accordance with a preferred embodiment of the invention, the inlet duct is formed of two metal cyliners, which are arranged one within the other and which together form a cylindrical double-casing. Between the cylinders is formed an annular slot wherethrough cooling medium is applied. The slot between the cylinders may be either undivided or divided into a plurality of separate sections. The space between the cylinders may, for example, be divided by means of vertical ribs extending from one cylinder to the other, whereby, depending on the quantity of the ribs, two or more separate vertical sections are formed between the cylinders for the cooling medium. Cooling medium may be conducted axially downstream or upstream with respect to the gas flow.

As regards to its structure and material, the inlet duct comprising metal cylinders is elastic. A sudden blow of a hammer on the outer surface of the duct causes a deformation of the duct wall, and the deposits accumualated on the inner surfaces of the duct are disengaged. As it is a cooled duct, the deposits formed on its wall are brittle as such and readily disengageable. Neither do deposits attach to smooth metal surfaces as firmly as to, e.g., refractory-lined surfaces. A stiff, refractory-lined or ceramic duct construction cannot be cleaned with sudden blows of a hammer because the material itself may not be resistant to blows and because a stiff structure does not deform, which would contribute to loosening of the deposit. A blow might also cause the stiff inlet duct to come loose from either end thereof.

An elastic and cooled inlet duct construction may, according to a second embodiment of the invention, be provided by employing a tube which is bended into a spiral or a snail, wherethrough cooling medium is then conducted.

The various layers of the tube bended into a spiral are not fixedly attached to one another, but allow at least some movement of the layers with respect to one another. Removal of the deposits from the inner surface of the inlet duct is effected by, e.g., a blow of a hammer, which is directed to one or more layers of the tube. Consequently, this layer will move with respect to adjacent tube layers, whereby the inner surface of the inlet duct is deformed. As a result of this, the deposits attached to the duct wall come loose. The hammerblow simultaneously causes vibration of the tube, which reflects both ways along the tube in the longitudinal direction. Vibration also loosens the deposits.

Water, steam, air or some other appropriate gas or liquid may be used as a cooling medium in cooled inlet ducts. In that case, also purified and cooled process gas may be used because, in itself, it does not add to the gas load. the most preferable cooling medium is, however, water e.g., because the cooling of the inlet duct may then be in connection with the water/steam circulation of the actual cooling chamber. The cooling medium may be pressurized gas or steam, in which case its heat transfer capacity is better. In that case, the inlet duct is preferably formed of a spirally wound tube, the pressure resistance whereof is higher.

A cooled inlet duct according to the invention has, e.g., the following advantages:

- cooling in itself embrittles the deposits accumulating on the duct walls, so they are readily removable by vibration or deformation of the duct;
- a metal duct is capable of vibrating and deforming due to a mechanical blow;
- an inlet duct of metal is solid and resistant to sudden mechanical force needed for cleaning, and extra particles do not come loose of its walls unlike, for example, of refractory-lined walls;
- deposits do not adhere to smooth metal surfaces as easily as to refractory-lined or ceramic surfaces;
- a metal duct is light and easy to connect to the cooling chamber and the process itself;
- heat may be recovered from a cooled duct.

The present invention is suitable for a great variety of processes. The temperature of the gases issuing from metallurgical processes is normally 700° to 1800° C. before they are conducted to the heat recovery stage, i.e., cooling, where they are normally cooled to a temperature of 350° to 1000° C. The radiation chamber of metallurgical furnaces produces gases of appr. 550° to 1200° C., which are also cooled to appr. 350° to 1000° C. Limestone burning and cement kilns produce gases of appr. 800° to 1000° C., which are cooled to 300° to 500° C. Flue gases from waste incineration furnaces have a relatively low temperature; it may be as low as 300° to 700° C. Still they may contain most different fouling components, which cause trouble until they are cooled to a temperature of appr. 200° to 250° C. Some metallurgical processes also produce gases which have a relatively low temperature but which nevertheless are fouling. Such gases may contain, for example, Pb or Zn compounds melting at a low temperature, and the gases have to be cooled to a relatively low temperature until the formation of deposits is avoided.

The temperature of the inlet duct cooling medium has to be always clearly lower than the eutectic temperature of the molten or vaporizing components contained in the hot gases from the process. This is inevitable for fast cooling of the fouling components which come into contact with the wall surfaces. For example, if water of 20° to 50° C. is used as a cooling medium, the temperature of this water may rise to about 100° C., i.e. without a phase change. The lower the inlet temperature of the cooling medium, the more porous the deposits in the gas duct will be. The temperature of the cooling medium normally rises by about 20°–100° C. in the inlet duct. Often, however, the rise in the temperature is not more than about 20°–30° C. It takes a longer time to cool the deposits in the gas duct by steam, the temperature of which is >200° C. and, consequently, the deposits in the duct become tougher than when using a cooler cooling medium. The gas temperature does not change very much in the inlet duct, usually not more than about 0.5°–25° C.

In the cooling chamber, cooling is effected by a circulating fluidized bed where cold particles are mixed with the gas, thereby lowering the gas temperature immediately below the eutectic temperature of the molten or vaporizing components contained in the gas. Deposits cannot therefore be accumulated on the walls of the cooling chamber.

BRIEF DESCRIPTION OF THE DRAWINGS

The invention will be described in greater detail in the following, by way of example, with reference to the enclosed drawings, in which.

DETAILED DESCRIPTION OF THE DRAWINGS

Figure 1:
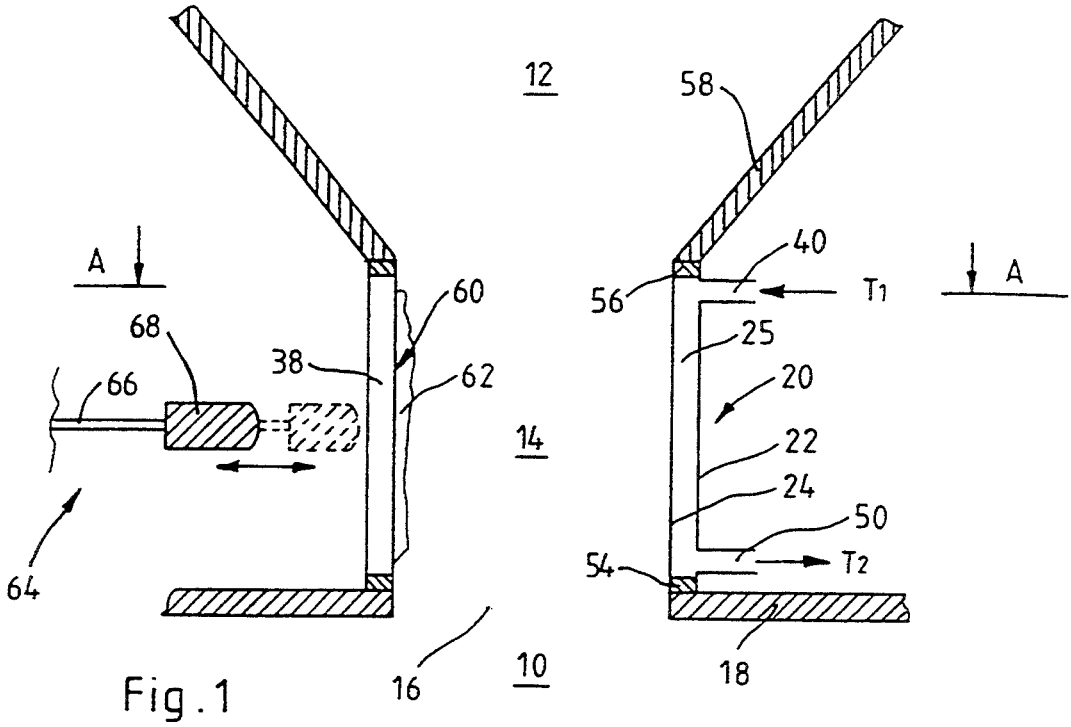
FIG. 1 illustrates an inlet duct arrangement according to the invention.
Figure 2:
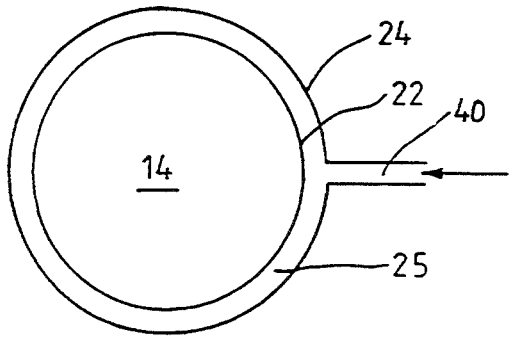
FIG. 2 is a sectional view of FIG. 1 taken along line A—A.

FIGS. 1 and 2 illustrate a cooled inlet duct 14 arranged between a process furnace 10 and a cooling chamber 12. The inlet duct is connected to an opening 16 in the roof 18 of the process furnace.

The inlet duct incorporates a cylinder 20 of an elastic double-casing structure, which is composed of metal cylinders 22 and 24 arranged one within the other. The cylinders may be made from a conventional, 3 to 7 mm thick steel plate. If the cooling medium is pressurized, the cylinders have to be made from a thicker plate. An annular space 25, wherethrough cooling medium is led, is formed between the cylinders. The cooling medium is conducted into the annular space 25 via conduit 40 and is discharged therefrom via conduit 50. The gap between the cylinders is, for example, about 5 to 25 mm, preferably 10 to 15 mm wide if water is used as a cooling medium. A gaseous cooling medium calls for a larger space, in which case the slot may be as wide as 50 mm. In the annular space are preferably disposed flow control means, not shown in the FIGS.

FIG. 2 is a cross-sectional view of the inlet duct 14 taken along line A—A. In this embodiment, the annular space 25 is a single, undivided space for liquid, which space is preferably provided with flow control means.

As shown in FIG. 1, the annular space 25 is sealed with packings 54 and 56 against the roof of the process furnace and the bottom 58 of the cooling chamber.

Deposits 62 possibly formed on the wall surface 60 of the inlet duct are removed with blow means 64. The blow means comprises a hammer 68 disposed at the end of an arm 66. A blow of the hammer causes a deformation and/or vibration of the inlet duct wall.

Figure 3:
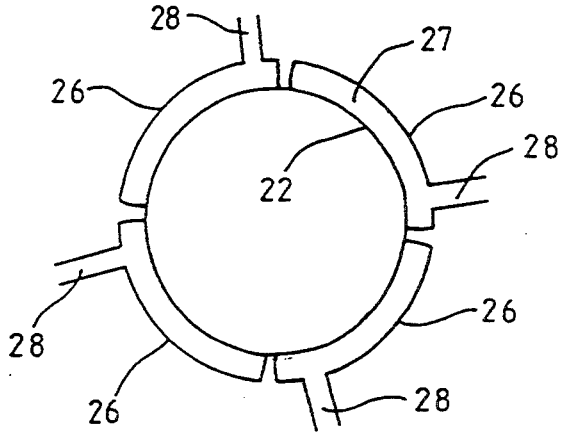
FIG. 3 is a sectional view along line A—A of a second inlet duct arrangement according to the invention.

On the other hand, as shown in FIG. 3, the space for the cooling medium may be formed of separate segments. The inner side of the double-casing structure 20 of the inlet duct incorporates, as shown in the above described FIGS., a cylinder 22, whereas the outer side of the casing is composed of separate, vertical plates 26, the edges whereof are bent towards the cylinder 22 so as to form watertight segment spaces 27 between the cylinder 22 and the plate 26. Each segment has an inlet duct 28 and an outlet duct (not shown) of its own.

Figure 4:
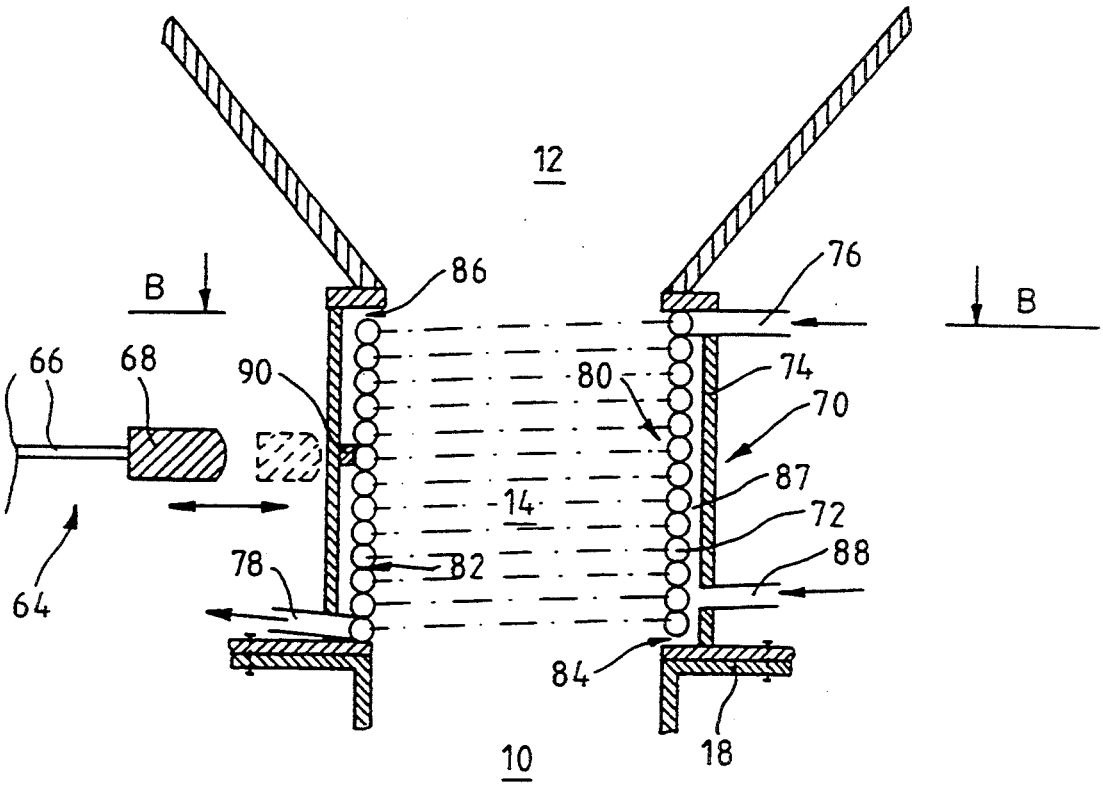
FIG. 4 illustrates the second inlet duct arrangement according to the invention.
Figure 5:
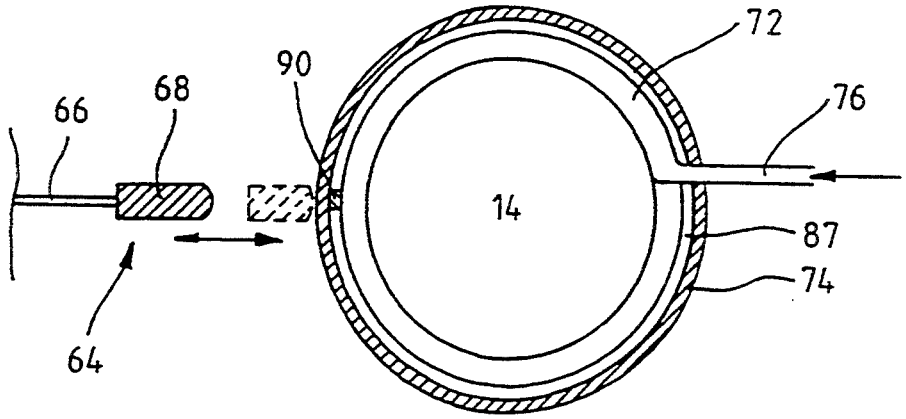
FIG. 5 is a sectional view of FIG. 4 along line B—B.

FIGS. 4 and 5 show an inlet duct 14 arranged between the process furnace 10 and the cooling chamber 12, the walls 70 of the inlet duct being formed of a tube 72 bent in the shape of a spiral or a snail. The tube spiral is partly surrounded with a cylindrical pressure-tight enclosure 74. The outer diameter of the tube 72 is typically 25 to 100 mm, preferably 38 or 52 mm. The cooling medium is fed into the tube from the upper end thereof via in inlet conduit 76 and is discharged from the lower end of thereof via an outlet conduit 78.

The tube 72 is so wound that it forms a flexible tube wall 80, where tubes arranged one on top of the other are not stiffly united, e.g., by welding. Various tube parts are movable with respect to adjacent tubes. Thus, small slots 82, 84 and 86 accessible to gas may be formed between the tubes, between the lowermost tube spiral and the roof of the process furnace and between the topmost tube spiral and the bottom of the cooling chamber. Hot process gas is prevented from leaking through the wall by enclosing the tube wall inside a pressure-tight enclosure or casing 74. A gas space 87 is formed between the casing and the tube construction, into which space interspace or slit gas or extrusion gas is introduced via conduit 88, the pressure of the extrusion gas being higher than that of the hot process gas, thereby preventing leakage of hot process gas. For example, purified and cooled, recirculated process gas of e.g., 20° to 200° C. or some other inert gas or air may be used as a slit gas. It is advisable to pay attention to the composition of the hot gases when the slit gas is selected. Oxygenous slit gas may be used if final combustion, if any, does not cause any trouble. In most cases, some inert gas is, however, the most appropriate choice. The volume of the slit gas is very small, and is therefore of no essential significance as to the total gas volume.

The slit gas keeps the slots between the tube layers clean and may, in larger volumes, form a cool gas coat on the inner surface of the inlet duct, preventing small drops from flowing towards the wall. The slit gas thereby forms a border layer on the inner surface of the duct.

If a more compact structure is desired, the ducts may be partly attached to one another with bars without binding them tightly to form a totally stiff structure. The bars may, e.g., be welded on to the lowermost and the uppermost tube, whereby the tube spiral structure will have a limited allowance in the vertical direction.

The tube spiral wall may also be made of a special tube, the cross section of the outer surface of which is not circular but approaches a square. Therefore, when bent into a spiral, it provides a larger sealing surface between the tube layers and, consequently, a more tight coupling structure than a circular tube.

A hammer may also be used in the arrangement according to FIGS. 4 and 5 to bring about a sudden deformation of the duct wall. At the point of the hammer-blow, between the enclosure 74 and the tube wall 80 is disposed a piece 90, which transmits the blow on the enclosure to a tube layer on the corresponding level. Blow hammers may be arranged opposite to each other or in several places in the duct. As a result of a blow, a spring type deformation of the duct occurs. It loosens deposits from the duct wall very effectively. Vibration reflecting in both directions of the duct contributes to loosening of the deposits.

The blow hammer may be arranged inside the gas space 87, whereby the blow of the hammer directly hits the wall formed of a spirally wound tube.

Sweeping may also be effected by instantaneously and in a pulse-like manner changing the pressure of the cooling medium in the duct, whereby the tube spiral tends to straighten out and vibrate, thus loosening the deposits from the duct.

In some cases, it is also possible to provide a deformation of the inlet duct by heat expansion, whereby the flow of the cooling medium is temporarily slowed down, and the duct is allowed to heat, whereafter it is rapidly cooled by returning the flow rate of the cooling medium to normal.

We claim:

1. A method of introducing hot process or flue gases into a fluidized bed gas cooler using an inlet duct having inner and outer surfaces, the fluidized bed gas cooler having a bottom and fluidized bed of cooling particles, and removing deposits which form on the inlet duct, comprising the steps of substantially simultaneously:

(a) introducing hot process or flue gases through the inlet duct, in contact with the inner surface thereof, into the bottom of the fluidized bed gas cooler as fluidizing gas for the cooling particles in the fluidized bed cooler; and (b) cooling the inlet duct by passing a cooling fluid into and then out of contact with the outer surface of the inlet duct in such a way that the cooling fluid increases in temperature but does not change phase, and so that deposits which form on the inlet duct interior surface become brittle, and readily disengageable.

2. A method as recited in claim 1 wherein the inlet duct is formed at least in part by a metal spiral tube; and wherein step (b) is practiced by circulating cooling fluid through the spiral tube from an inlet to an outlet.

3. A method as recited in claim 2 wherein step (b) is further practiced by circulating cooling fluid through the spiral tube under superatmospheric pressure.

4. A method as recited in claim 3 comprising the further step of at different times disengaging deposits which form on the inlet duct and become brittle by effecting pulsation of the pressure of the cooling fluid circulating through the spiral tube, which causes movement of the spiral tube, and disengagement of the deposits therefrom.

5. A method as recited in claim 2 comprising the further step of at different times disengaging deposits which form on the inlet duct and become brittle by effecting pulsation of the temperature of the cooling fluid circulating through the spiral tube, which causes thermal expansion or contraction and subsequent movement of the sprial tube, and disengagement of the deposits therefrom.

6. A method as recited in claim 2 wherein the inlet duct is also formed by an enclosure surrounding the spiral tube, and wherein a connecting piece extends between the enclosure and the spiral tube; and comprising the further step of at different times disengaging deposits which form on the inlet duct and become brittle by subjecting the enclosure to a sudden mechanical force which is transmitted to the spiral tube through the connecting piece, causing movement of the spiral tube and disengagement of brittle deposits therefrom.

7. A method as recited in claim 2 wherein the inlet duct is also formed by an enclosure surrounding the spiral tube, a connecting piece extending between the enclosure and the spiral tube; and comprising the further step of circulating a gas between the enclosure and the spiral tube under a superatmospheric pressure higher than the pressure of the process or flue gas in the inlet duct to prevent leakage of process or inlet gas between coils of the spiral tube.

8. A method as recited in claim 2 comprising the further step of at different times disengaging deposits which form on the inlet duct and become brittle by subjecting the spiral tube to a sudden mechanical force, causing movement of the spiral tube and disengagement of brittle deposits therefrom.

9. A method as recited in claim 1 comprising the further step of at spaced time intervals disengaging deposits which form on the inlet duct and become brittle by subjecting the exterior surface of the inlet duct to a sudden mechanical force, causing movement of the inlet duct and disengagment of brittle deposits therefrom.

10. A method as recited in claim 1 wherein the outer surface of the inlet duct is surrounded by a jacket, and wherein step (b) is practiced by continuously passing cooling fluid through the jacket.

11. A method as recited in claim 1 wherein the cooling fluid is water, and wherein step (b) is practiced so that the maximum temperature variation of the water from the time it comes into contact with the outer wall of the inlet duct until it moves out of contact is 20° C. to about 100° C.

12. A method as recited in claim 1 wherein step (b) is practiced so that the temperature increase of the cooling fluid from the time it comes into contact with the outer wall of the inlet duct until it moves out of contact is about 20°–30° C.

13. A method as recited in claim 1 comprising the further step of circulating cooling particles of the fluidized bed into and out of the fluidized bed.

14. A fluidized bed gas cooler assembly, comprising:

a fluidized bed gas cooler having a bottom, and a bed of cooling particles therewithin;

a metal inlet duct connected to said gas cooler bottom for directing hot process or flue gases into said gas cooler as fluidizing gas, said inlet duct having an inner surface which contacts gases being directed thereby, and an outer surface; and means for circulating a cooling fluid into and out of contact with said outer surface of said inlet duct from an inlet to an outlet, to cool said inlet duct sufficiently to cause deposits which form on said inlet duct inner surface to become brittle and easily dislodged.

15. An assembly as recited in claim 14 wherein said circulating means comprises a jacket surrounding said inlet duct, having an inlet at a first portion thereof, and an outlet at a second portion thereof spaced from said first portion.

16. An assembly as recited in claim 14 wherein said inlet duct is formed at least in part by a metal spiral tube, and wherein said circulating means comprises said spiral tube including an inlet at one end thereof, and an outlet at another end thereof.

17. An assembly as recited in claim 16 wherein said inlet duct further comprises a gas-tight enclosure surrounding said spiral tube, and spaced therefrom to define a volume.

18. An assembly as recited in claim 17 further comprising means for introducing gas under superatmospheric pressure into said volume between said enclosure and said spiral tube.

19. An assembly as recited in claim 16 further comprising means for effecting movement of said spiral tube at different times to effect dislodgment of deposits formed thereon.

20. An assembly as recited in claim 19 wherein said means for effecting movement of said spiral tube comprises means for applying a sudden mechanical force to said spiral tube.

21. An assembly as recited in claim 20 further comprising an enclosure surrounding said spiral tube, and a connecting piece between said enclosure and said spiral tube; and wherein said means for applying a sudden mechanical force to said spiral tube comprises a hammer for applying a sudden mechanical force to said enclosure, which is transmitted through said connecting piece to said spiral tube.

22. An assembly as recited in claim 14 further comprising means for effecting movement of said inlet duct at different times to effect dislodgment of deposits formed thereon.

23. An assembly as recited in claim 22 wherein said means for effecting movement of said inlet duct at different times comprises means for applying a sudden mechanical force to said inlet duct from the exterior thereof.

24. An assembly as recited in claim 23 wherein said means for applying a sudden mechanical force to said inlet duct from the exterior thereof comprises a hammer mounted on an arm.

25. An assembly as recited in claim 14 wherein said circulating means comprises a plurality of fluid-tight segments surrounding said inlet duct, each having an inlet at a first portion thereof, and an outlet at a second portion thereof spaced from said first portion.

26. A method of introducing hot process or flue gases into a fluidized bed gas cooler using an inlet duct having inner and outer surfaces, the fluidized bed gas cooler having a bottom, and a fluidized bed of cooling particles, and removing deposits which form on the inlet duct, comprising the steps of:

(a) introducing hot process of flue gases through the inlet duct, in contact with the inner surface thereof, into the bottom of the fluidized bed gas cooler as fluidizing gas for the cooling particles in the fluidized bed cooler;

(b) cooling the inlet duct so that deposits which form on the inlet duct interior surface become brittle, and readily disengageable; and (c) at different times disengaging deposits which form on the inlet duct and become brittle by subjecting the inlet duct to a sudden mechanical force.

* * * * *